US008807175B2

(12) United States Patent
Lin et al.

(10) Patent No.: US 8,807,175 B2
(45) Date of Patent: Aug. 19, 2014

(54) METHOD FOR MANUFACTURING WEAVING MATERIAL FROM NONWOVEN

(76) Inventors: Jing-Jyr Lin, Taoyuan County (TW); Jen-Sheng Tsai, Taoyuan County (TW)

( * ) Notice: Subject to any disclaimer, the term of this patent is extended or adjusted under 35 U.S.C. 154(b) by 0 days.

(21) Appl. No.: 13/167,863

(22) Filed: Jun. 24, 2011

(65) Prior Publication Data

US 2011/0308051 A1 Dec. 22, 2011

Related U.S. Application Data

(63) Continuation-in-part of application No. 12/438,381, filed on Sep. 23, 2009, now abandoned.

(51) Int. Cl.
*D03D 15/00* (2006.01)
*D04B 39/00* (2006.01)

(52) U.S. Cl.
USPC ..... 139/420 R; 66/202

(58) Field of Classification Search
USPC ..... 66/202; 139/383 R, 407, 420 R, 424
See application file for complete search history.

(56) References Cited

U.S. PATENT DOCUMENTS 3,361,616 A * 1/1968 Scharf ..... 428/376
3,398,220 A * 8/1968 Port et al. ..... 264/147
3,492,389 A * 1/1970 Port et al. ..... 264/147
3,627,604 A * 12/1971 Davies et al. ..... 156/148
3,664,115 A * 5/1972 Watson ..... 57/31
3,837,980 A * 9/1974 Nishimura et al. ..... 428/17
4,129,632 A * 12/1978 Olson et al. ..... 264/40.1
4,145,467 A * 3/1979 Malik ..... 428/91
4,384,018 A * 5/1983 Caswell et al. ..... 428/95
4,478,900 A * 10/1984 Nebe et al. ..... 428/92
4,697,407 A * 10/1987 Wasserman ..... 57/238
4,906,520 A * 3/1990 Kumar ..... 442/186
5,071,699 A * 12/1991 Pappas et al. ..... 442/110
5,735,640 A * 4/1998 Meyer et al. ..... 405/302.7
2002/0033222 A1* 3/2002 Anderegg et al. ..... 156/174
2006/0003653 A1* 1/2006 Hart et al. ..... 442/104
2006/0013998 A1* 1/2006 Stelljes, et al. ..... 428/174
2010/0024489 A1* 2/2010 Lin et al. ..... 66/202
2011/0308051 A1* 12/2011 Lin et al. ..... 28/167

FOREIGN PATENT DOCUMENTS

JP 09172883 A * 7/1997

* cited by examiner

*Primary Examiner* — Danny Worrell
(74) *Attorney, Agent, or Firm* — Rosenberg, Klein & Lee

(57) ABSTRACT

The present invention provides a method for producing thread using nonwoven, which discloses that nonwoven having different materials is slit first to get a plurality of nonwoven threads and then the nonwoven threads are used for performing a twisting process to get a plurality of nonwoven yarns. In the twisting process, each of the nonwoven threads has different materials, so that the nonwoven yarns have good mechanical characteristic and can be added for producing textiles with various functionalities.

5 Claims, 3 Drawing Sheets

METHOD FOR MANUFACTURING WEAVING MATERIAL FROM NONWOVEN

REFERENCE TO RELATED APPLICATIONS

This Application is a Continuation-in-Part of patent application Ser. No. 12/438,381, filed 23 Sep. 2009, currently pending.

FIELD OF THE INVENTION

The present invention relates to a method for providing weaving material, and particularly to a method for producing thread using nonwoven.

BACKGROUND OF THE INVENTION

The textile industry is an industry of manufacturing textile goods using a variety of textile raw materials. The main fabrication processes include fiber production, spinning, textile manufacturing, dyeing and printing, finishing, and the final read-to-wear business. The textile industry is an important civil industry of a country. The applications of textile goods include the ready-to-wear business, the upholstery, and the industrial products. The ready-to-wear business includes garments for men, women, and children. The upholstery includes furniture, domestic goods, and domestic decorative cloth, etc. The industrial products include conveyers in factories, filtering cloth, and outdoor tent appliances. In addition, textile goods can be applied to shoemaking and interior decoration of transportations (automobiles or airplanes). Their applications are extremely extensive. Among them, the read-to-wear industry occupies the most significant proportion.

In general, weaving can be classified into knitting and tatting:

1. Knitting: A weaving method that uses a single thread of yarn or a set of threads of yarn to move unidirectionally, and classified into manual knitting and machine knitting.
   (a) Manual knitting is performed using two knitting needles alternately. Loops are distributed uniformly on the knitting needle. A row of loops is formed with width the same as that of the textile. When knitting is performed, the row of loops will connect with next row of loops. In this way, a textile is knitted.
   (b) Machine knitting uses a knitting needle in each of the loops. When knitting, all knitting needles are operating simultaneously and forming a row of loops.
2. Tatting: Knitting a thread of warp yarn and a thread of well yarn perpendicularly. The warp yarn is the vertical yarn; the well yarn is the horizontal yarn. In fact, when the primitives first interwove branches of a tree and grass to form a mat or a basket, the history of weaving was started.

In addition, there exists a textile formed without the spinning process. Firstly, a fiberweb structure is formed by arranging short fibers or long filaments at fixed orientation or randomly. Then, a mechanical, thermal bonding, or chemical method is adopted to fix the fiberweb structure. To put it in a nutshell, the textile is not formed by interweaving or knitting threads of yarn, but is formed by bonding fibers together through a physical means directly. Thereby, it is not possible to find any end of a thread in the textile. Nonwoven breakthroughs traditional weaving principles with the advantages of short manufacturing process, fast production speed, high throughput, low cost, wide applications, and having varied material sources. The main applications include:

1. Medical hygienic cloth: surgery gowns, protection clothing, sterilized cloth, facemasks, diapers, and feminine sanitary napkins, etc.;
2. Domestic decorative cloth: wallpaper, tablecloths, bed sheets, and coverlets, etc.;
3. Backing: lining, bonding lining, flocculus, shaping cotton, and various base cloth for synthetic leather, etc.;
4. Industrial cloth: filtering materials, insulation materials, packing bags for cement, earthwork cloth, and covering cloth, etc.;
5. Agricultural cloth: agriculture mulch, cloth for raising seedlings, irrigation cloth, and thermal insulating curtains, etc.;
6. Others: space cotton, heat and sound insulating materials, oil absorption felts, cigarette filters, and tea bags, etc.

Nonwoven can be classified into:

1. Spunlace nonwoven: Jet high-pressure minute water to a single or multiple layered fiberweb to entangle the fibers. Thereby, the fiberweb can be reinforced and t its strength is increased.
2. Heat-bonded nonwoven: Add fiber-shaped or powdery heat-melt binding and reinforcing materials to a fiberweb. Then the fiberweb is heated and cooled to form reinforced cloth.
3. Airlaid pulp nonwoven: The airlaid pulp nonwoven is also called airlaid paper or drylaid nonwoven. Wood pulp fibers are loosened up into single fibers. Next, air is applied to agglomerate the fibers onto a web curtain. The fiberweb is then reinforced to form cloth.
4. Wetlaid nonwoven: Fiber raw materials placed in water are loosened up into single fibers and mixed with various fiber raw materials to give fiber suspensions. The suspensions are delivered to the webbing mechanism. The fibers are laid into web under wet conditions and then reinforced to form cloth.
5. Spunbonded nonwoven: Polymers are extruded and lengthened to form continuous long threads, which are laid into a fiberweb. The fiber web is then processed to form nonwoven through self-bonding, heat-bonding, chemical bonding, or mechanical reinforcement methods.
6. Meltblown nonwoven: Polymers are melt and extruded to form fibers. The fibers are cooled and blown into a fiberweb. Then the fiberweb is reinforced to form cloth.
7. Needle-punched nonwoven: This is one kind of drylaid nonwoven. The punching effect of needles is used to reinforce a loose fiberweb.
8. Stitch-bonded nonwoven: This is one kind of drylaid nonwoven. Use warp and weft loop structures to reinforce the fiberweb, yarn layer, non-fabric materials (such as plastic flakes, plastic foils, metal foils, etc.) or their combinations and form nonwoven.

Accordingly, before weaving process, taking polymer material as an example, the preparation process is very complicated including synthesis, reeling, and spinning. During reeling and spinning, mechanical strength of fibers is extremely important because fibers are reeled and pulled by machines. If the mechanical strength of fibers is not enough, difficulties will result. The present invention provides a method using nonwoven as the yarn, eliminating the need of considering mechanical characteristics of fibers while the nonwoven includes different materials.

SUMMARY

An objective of the present invention is to provide a method for producing thread using nonwoven, which can provide nonwoven yarns for applying into a weave procedure without the need of considering physical characteristics, such as strength and stress, of fibers.

In order to achieve the objectives and effects described above, the present invention provides a method for producing thread using nonwoven, which discloses that nonwoven including different materials is slit first, and obtaining a plurality of nonwoven threads, and then the nonwoven threads are used for a twisting process to get a plurality of nonwoven yarns. In the twisting process, the nonwoven yarns with different materials have good mechanical characteristics and can be added for producing textiles with various functionalities while each of the nonwoven threads are manufactured from the nonwoven with different materials.

DETAILED DESCRIPTION

In order to make the structure and characteristics as well as the effectiveness of the present invention to be further understood and recognized, the detailed description of the present invention is provided as follows along with preferred embodiments and accompanying figures.

The present invention uses nonwoven as the yarn, and weaves with itself or yarn of other materials to produce cloth.

Figure 1:
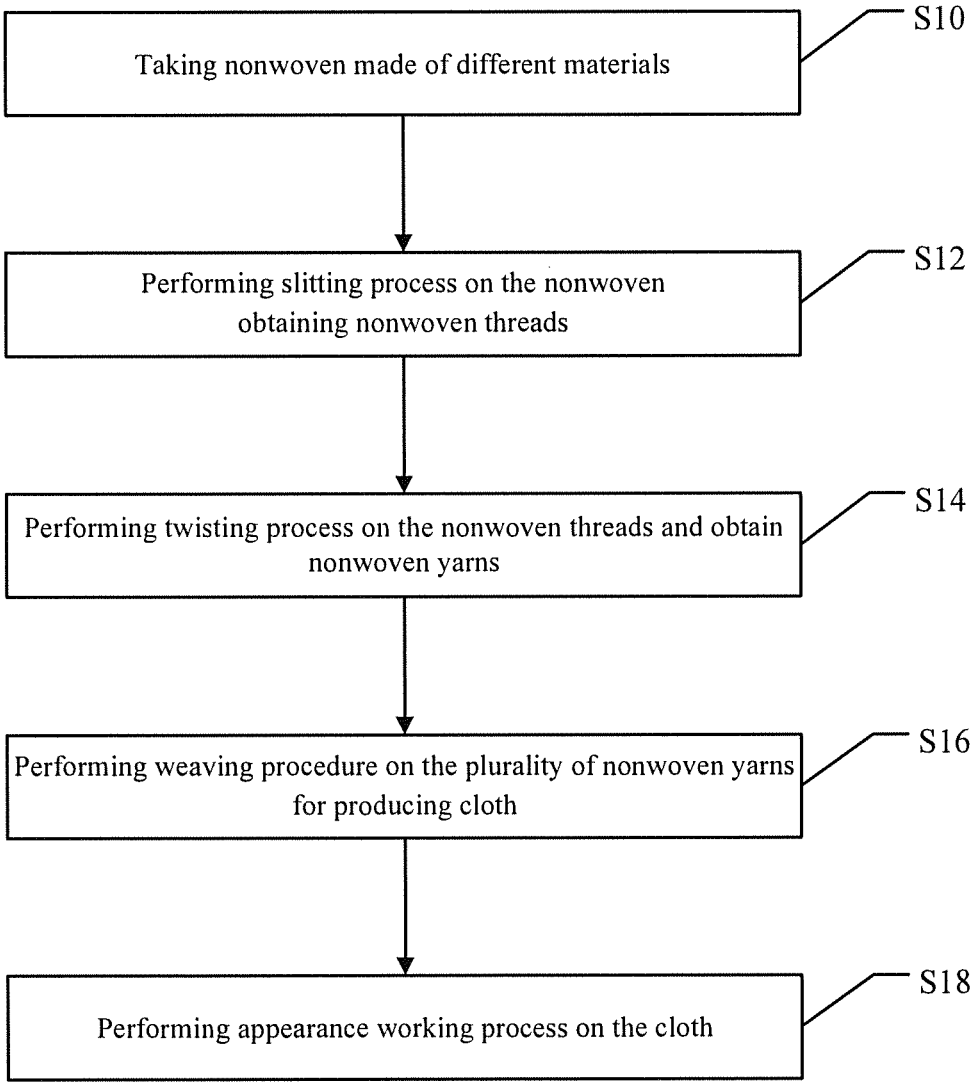
FIG. 1 shows a manufacturing flowchart according to a preferred embodiment of the present invention.

FIG. 1 shows a manufacturing flowchart according to a preferred embodiment of the present invention. As shown in the figure, the present invention uses nonwoven having different materials to produce the yarns, and comprises steps of: step S10, taking nonwoven, the nonwoven is made of different materials, such as Polyester, Polypropylene, Polyethene, polyvinyl ester, polyolefin; step S12, performing slitting process on the nonwoven and obtaining a plurality of nonwoven threads. Due to the nonwoven made of different materials, the nonwoven yarns get good mechanical characteristics, such as textile strength and stress; the step S14, twisting the nonwoven threads to obtain a plurality of nonwoven yarns. Otherwise, the steps further comprises steps S16 and S18, wherein the step S16, performing a weaving procedure on the plurality of nonwoven yarns for producing cloth, wherein the weaving procedure is performed by tatting, knitting, plain weaving, or mesh weaving. The step S18, performing a appearance working process on the cloth produced by the nonwoven yarns, where the cloth is dyed or printed with at least one pattern or at least one stamp, such as dyeing or printing the flower pattern, gear pattern, block stamp, or cloud stamp on the cloth during the appearance working process. The dyed cloth gets different color effect due to the nonwoven yarns made from the nonwoven made by different materials with different rendering properties. Otherwise, the cloth is also able to be coated with a water-resistant material during the appearance working process, for adding the water-resistant property on the cloth.

Further, due to the nonwoven made of different materials, the shapes of the patterns or the stamps would be contoured obviously. For example, the appearance effect of the cloth is determined by the different depth of the stamp on the cloth. On the other hand, the solid impression of the cloth would be enhanced by the different depth of the stamp caused by the different materials arranged cross each other.

Because nonwoven has the physical characteristics of softness, using it as the yarn can increase usability of cloth. In addition, by taking advantage of the softness characteristics of nonwoven along with various weaving schemes, different appearances and applications can be provided.

The nonwoven described above is the fabrics manufactured by bonding, needle punching, water mangling, heat melting, spunbonding, and meltblowing using different materials as the raw material. The nonwoven described in the present invention is not the technological characteristic of the present invention. Thereby, cloth manufactured by wetlaid, drylaid, or polymer extrusion can be used as well.

Figure 2:
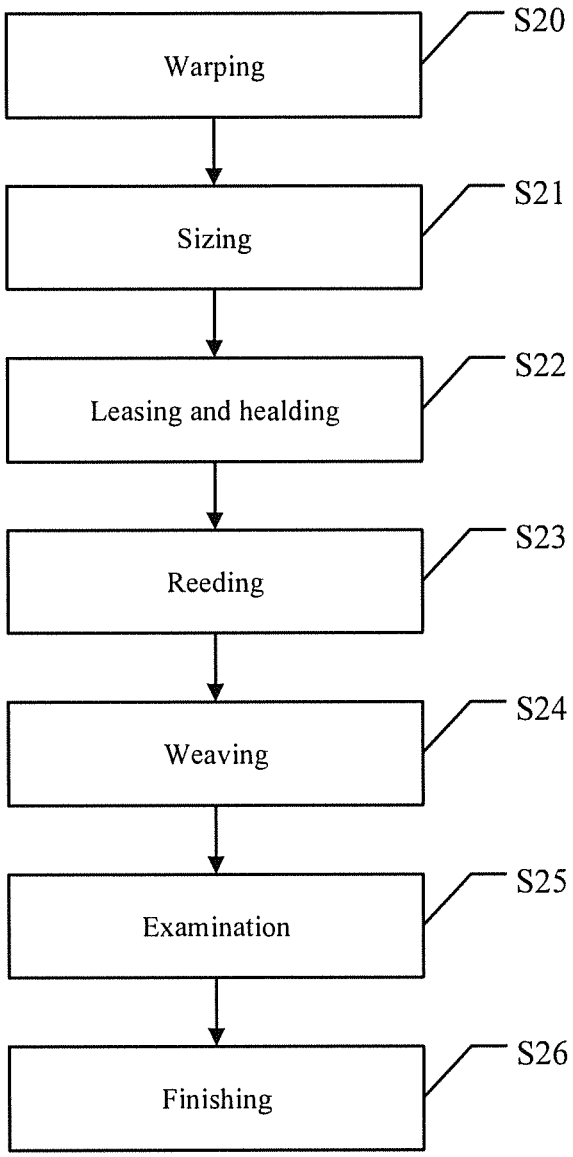
FIG. 2 shows a weaving flowchart according to a preferred embodiment of the present invention.

Furthermore, the weaving methods according to the present invention include tatting, knitting, plain weaving, or mesh weaving. Taking tatting as an example and referring to FIG. 2, the weaving method comprises the following steps. Step S20, warping: organize the yarn and install it on the beam. Step S21, sizing: the strength of yarn is not sufficient. Hence the yarn has to immerse into the thick amylum liquid. Step S22, leasing and healding: divide the threads in the beam into odd and even threads, and install them in the heald frame. Step S23: reeding: installing the heald frame to the weaving machine. Step S24, weaving: when the warp yarn is carried up or down depending on odd or even numbering, the weft yarn is carried by a shuttle back and forth to weave the two sets of yarns. Step S25, examination: Examine if flaws exist in the woven cloth. Mending is performed if required. Step S26, finishing: deliver the finished textile or perform further dyeing and finishing.

Figure 3:
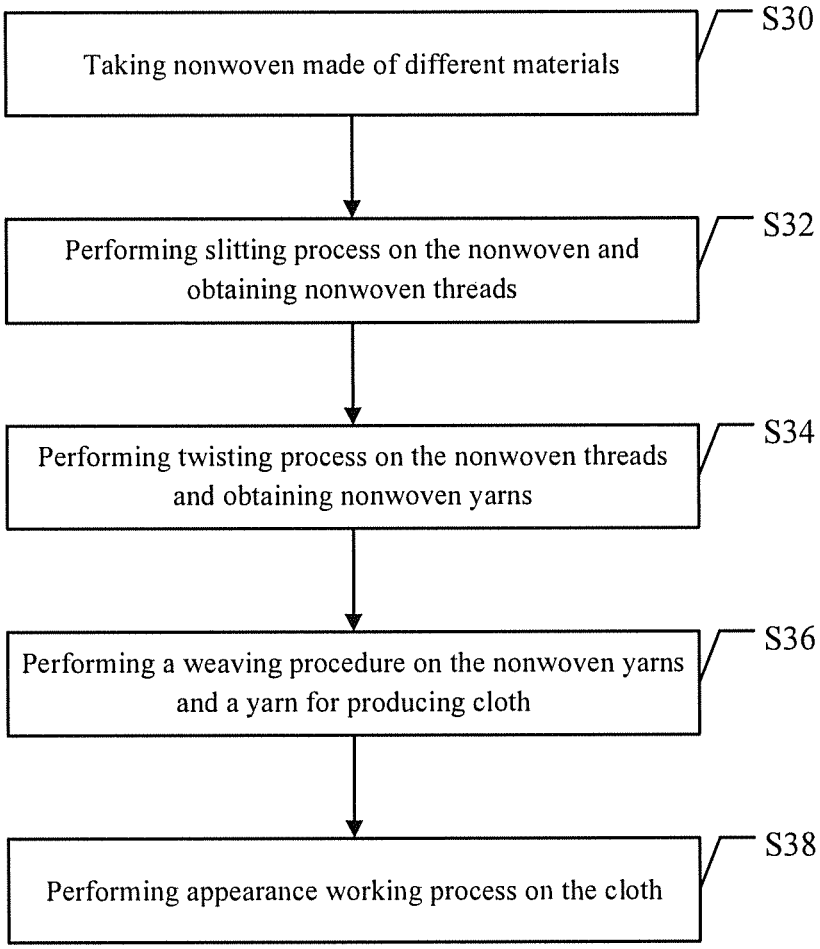
FIG. 3 shows a manufacturing flowchart according to another preferred embodiment of the present invention.

FIG. 3 shows a manufacturing flowchart according to another preferred embodiment of the present invention. As shown in the figure, the manufacturing process according to another preferred embodiment of the present invention comprises steps of: step S30, taking nonwoven, the nonwoven is also made of different materials; step S32, performing slitting process on the nonwoven and obtaining a plurality of nonwoven yarns; step S34, performing a twisting procedure on the plurality of nonwoven threads to obtain a plurality of nonwoven yarns. The steps further comprises steps S36 and S38, wherein step S36, performing a weaving procedure on the plurality of nonwoven yarns and a thread of yarn for producing cloth, the weaving procedure is performed by tatting, knitting, plain weaving, or mesh weaving. The step S38, performing a appearance working process on the cloth produced by the nonwoven yarns, wherein the cloth is dyed or printed with at least one pattern or at least one stamp, such as the flower pattern, gear pattern, block stamp, or cloud stamp during the appearance working process.

Because yarn with different materials, which includes polymer, metal, or nonmetal materials, can be woven with the nonwoven yarns according to the present invention, textiles with various functionalities can produced. Besides, tatting or knitting or plain weaving or mesh weaving can be applied during weaving. Furthermore, the light shielding characteristic of the cloth is further made from the plain weaving or mesh weaving.

Accordingly, the present invention conforms to the legal requirements owing to its novelty, non-obviousness, and utility. However, the foregoing description is only a preferred embodiment of the present invention, not used to limit the scope and range of the present invention. Those equivalent changes or modifications made according to the shape, structure, feature, or spirit described in the claims of the present invention are included in the appended claims of the present invention.

The invention claimed is:

1. A method for manufacturing weaving material from nonwoven, comprising steps of:

taking a nonwoven, the nonwoven being made of layered fiberwebs, the fiberwebs being made of a plurality of fibers having different materials distributed cross each other and in random arrangement by heat-bonding;

performing a slitting process on the nonwoven to produce a plurality of nonwoven yarns with different materials distributed therein randomly;

performing a weaving procedure on the plurality of nonwoven yarns to produce a cloth; and performing an appearance working process on the cloth produced from the nonwoven yarns to contour the cloth having at least one pattern or stamp thereon.

2. The method of claim 1, wherein the appearance working process further comprises a coating process for coating a water-resistant material on the cloth.

3. The method of claim 1, wherein the step of the weaving procedure is performed by further using a yarn for producing cloth.

4. The method of claim 3, wherein the yarn is a polymer yarn or a metal yarn or a nonmetal yarn.

5. The method of claim 1, wherein the weaving procedure is tatting or knitting or plain weaving or mesh weaving.

* * * * *